United States Patent [19]

Erlandson

[11] 4,373,213

[45] Feb. 15, 1983

[54] ARCHERY ARM GUARD

[76] Inventor: Roger S. Erlandson, 8600 Rubio Dr., Elk Grove, Calif. 95624

[21] Appl. No.: 225,472

[22] Filed: Jan. 16, 1981

[51] Int. Cl.[3] ..... A41D 13/08; A63B 57/00

[52] U.S. Cl. ..... 2/16; 273/189 R

[58] Field of Search ..... 2/16, 17, 18; 273/189 R, 189 A, 54 B

[56] References Cited

U.S. PATENT DOCUMENTS

| | | | |
|---|---|---|---|
| 3,304,555 | 2/1967 | Anderson et al. | 2/16 |
| 3,423,095 | 1/1969 | Cox | 2/16 |
| 3,855,633 | 12/1974 | Rhee | 2/18 |
| 4,048,674 | 9/1977 | Chesnick | 2/16 |

*Primary Examiner*—Doris L. Troutman
*Attorney, Agent, or Firm*—Donald E. Nist

[57] ABSTRACT

An improved archery arm guard is provided to prevent bowstring slap when shooting an archery bow. The arm guard features an elongated, preferably transversely curved, smoothly surfaced self-supporting body defining a number of internal preferably transvese passageways through which freely extend bads, straps, cords or the like, to releasably secure the arm guard in place on an archer's arm. The bands preferably are stretchable and include free ends bearing releasable securing devices such as snap buttons, Velcro strips or the like. Preferably, the body of the arm guard is curved down at the rear end to prevent inadvertent hooking of the bowstring under the arm guard during shooting of the bow. Moreover, the body is preferably curved up at the front end thereof to prevent its binding against the archer's wrist in use. The front end may be hinged to the rest of the body to facilitate its bending and the top surface of the arm guard may bear preferably colored longitudinal lines, ridges, grooves, or the like to help align the arm guard on the arm and help align the arm bearing the arm guard for accurate reproducible shooting. The arm guard is simple, inexpensive, durable, adjustable, efficient, and comfortable, and does not abrade the bowstring.

7 Claims, 4 Drawing Figures

ARCHERY ARM GUARD

BACKGROUND OF THE INVENTION

1. Field of the Invention

The present invention generally relates to archery devices and more particularly to an improved archery arm guard.

2. Prior Art

Conventional archery arm guards are in the form of a metal- or plastic rib- reinforced flat flexible leather strip releasably held to the archer's arm by bands sewn to the side edges of the strip. Such strips are not contoured from end to end to conform to the arm and thus have certain distinct disadvantages. Frequently, the archery bowstring, when released during shooting of an archery longbow held by the archer, catches under the rear end of the flat strip, painfully striking the archer's arm, dislodging the arm guard and spoiling the shot. Moreover, the straight front end of the strip has a tendency to dig into and abrade the archer's wrist as the wrist is flexed while holding and aiming the bow. In addition, the leather surface of the strip, particularly with its sides sewn to the supporting bands, is not smooth, so that when the bowstring slaps the strap during shooting, as is often the case, the bowstring is abraded thereby, wearing out and weakening more rapidly than would otherwise be the case. Finally, most conventional arm guards tend to move out of an optimal position during use and are relatively uncomfortable to wear.

Accordingly, there is a need for an archery arm guard of an improved type which would be comfortable to wear, inexpensive and durable and which would not readily wear out the bowstring. Of more importance, the arm guard should be designed such that the bowstring will not catch under it during shooting of the bow. The arm guard should also permit free wrist flexing without binding against the arm guard and should be easily positioned into and stay positioned in an optimal position during shooting.

SUMMARY OF THE INVENTION

The improved archery arm guard of the present invention satisfies all the foregoing needs. It is substantially as set forth in the Abstract above. Thus, it features an elongated, smooth surfaced, self-supporting body which does not abrade a bowstring. The arm guard body has internal passageways receiving the straps or bands by which the body is secured in place to an archer's arm.

The body is curved down at the rear to prevent inadvertent hooking of the bowstring thereunder, and is curved transversely so as to be contoured to the archer's arm for easy optimal positioning and retention thereof. The front end of the body is curved up to permit free, non-binding flexing of the wrist. The body is also provided with air passages to cool the arm when the guard is being used.

In one embodiment, the front end is hinged to facilitate its bending and the top surface of the body bears one or more colored longitudinal lines to aid in positioning the guard on the archer's arm and to aid in positioning the archer's arm relative to the bow for accurate reproducible shooting. Further features are set forth in the following detailed description and accompanying drawings.

DRAWINGS

DETAILED DESCRIPTION

Figure 1:
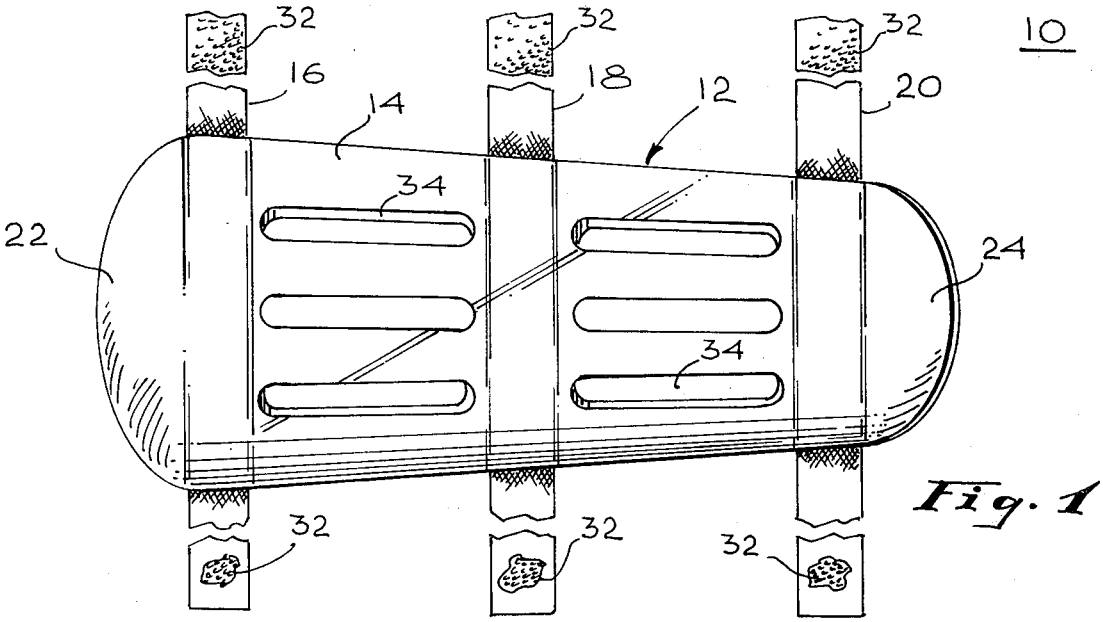
FIG. 1 is a schematic fragmentary top plan view of a first preferred embodiment of the improved archery arm guard of the present invention.
Figure 2:
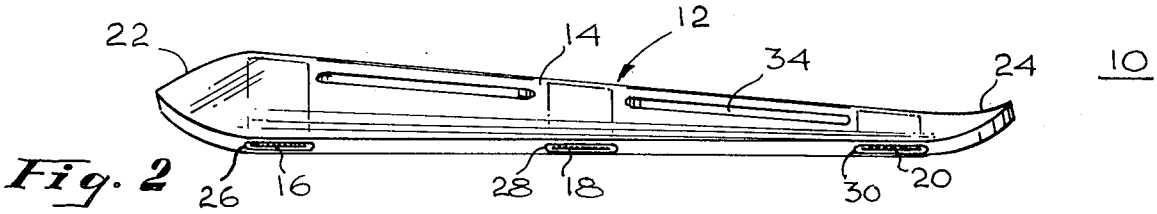
FIG. 2 is a schematic side elevation of the arm guard of FIG. 1.

FIGS. 1 and 2

Now referring more particularly to FIGS. 1 and 2 of the accompanying drawings, a first preferred embodiment of the improved archery arm guard of the present invention is schematically depicted therein. Thus, arm guard 10 is shown which comprises an elongated substantially protective self-supporting body 12 having a smooth curved upper surface 14, and three spaced arm bands or straps 16, 18 and 20. Body 12 may be transparent (as shown in FIGS. 1 and 2), translucent or opaque and preferably is formed of relatively rigid plastic such as polyethylene, or an acrylic resin such as those sold under the U.S. registered trademark Lucite by E. I. du Pont de Nemours & Co., Wilmington, Del. Alternatively, the body 12 can be made of another plastic or metal such as aluminum, steel, magnesium, titanium or an alloy thereof, or can be of wood, ceramic, cermet, etc. Usually, plastic is used because it is strong, light, corrosion resistant, easily formed and is inexpensive and durable.

Body 12 may be unitary and is curved transverely to conform to the countour of an archer's arm and is also curved down at its rear end 22 and up at its front end 24. It also slopes very slightly and gently down from about rear end 22 to about front end 24. The rear end curvature follows that of the arm and assures a snug comfortable fit without any danger of having a bowstring during shooting of an archery longbow hook under rear end 22 and drive guard 10 forward, thus sapping the shot, and painfully abrading the archer's arm with the bowstring under the arm guard. The raised front end 24 permits free flexing of the archer's wrist without the wrist being pinched by and dug into by body 12.

Bands 16, 18 and 20 preferably are flexible stretch bands of rubberized cloth or the like, although non-stretchable bands of leather, etc., can also be used. Bands 16, 18 and 20 are disposed in passageways 26, 28 and 30 disposed transversely through body 12 and extend laterally thereof, ending in releasable securing means, such as Velcro fasteners 32 on opposite ends thereof. It will be understood that snap fasteners, buttons and eyes, hooks, etc. could be substituted for the velcro. Bands 16, 18 and 20 slide freely in passageways 26, 28 and 30 and are concealed by body 12, so that surface 14 is kept smooth, thereby minimizing bowstring abrasion during shooting, when the bowstring contacts surface 14 and slides therealong. Moreover, bands 16, 18 and 20 can easily be replaced when worn out or damaged.

Body 12 is comfortable to wear and includes spaced elongated air channels or slots 34 extending therethrough to keep the archer's arm cool. Since body 12 is shaped to naturally conform to the archer's arm, it does not require heavy tension by bands 16, 18 and 20, as do conventional flat arm guards, to force it closely against the archer's arm. Accordingly, the lighter band tension contributes to comfort in wearing guard 10. So also does the longer length of bands 16, 18 and 20, in contrast to shorter conventional straps sewn to the sides of the arm guards. Moreover, guard 10 can easily be used on the right or left arm, in contrast to conventional arm guards. Guard 10 is smooth surfaced top and bottom to enhance comfort, in contrast to lumpy steel reinforced conventional arm guards, and guard 10 is also non-absorbent and unaffected by temperature, rain etc., in contrast to leather and cloth arm guards. Guard 10 is simple and inexpensive to make, highly effective in use and is durable.

Figure 3:
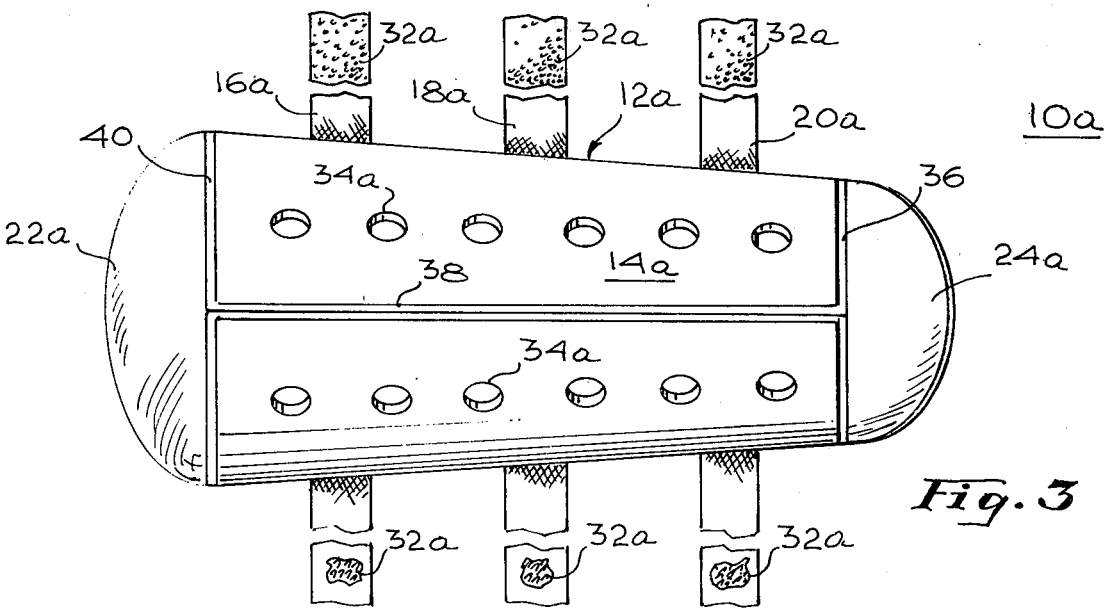
FIG. 3 is a schematic fragmentary top plan view of a second preferred embodiment of the improved archery arm guard of the present invention; and, FIG. 4 is a schematic side elevation of the arm guard of FIG. 3.
Figure 4:
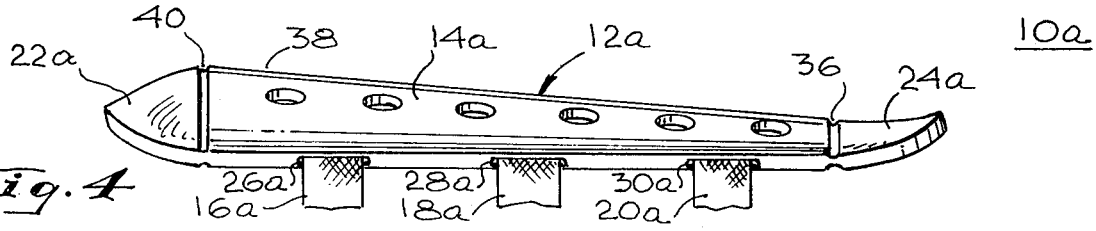

FIGS. 3 and 4

A second preferred embodiment of the improved archery arm guard of the present invention is schematically depicted in FIGS. 3 and 4. Thus, arm guard 10*a* is shown which is generally similar to guard 10. Components thereof similar to those of guard 10 bear the same numerals but are succeeded by the letter "a". Thus, guard 10*a* comprises an elongated generally flat body 12*a* with a smooth upper surface 14*a*, which is gently curved transversely to conform to an archer's arm, and is curved down at rear end 22*a* and curved up at front end 24*a*. Guard 10*a* includes spaced parallel arm bands 16*a*, 18*a* and 20*a* disposed in transverse passageways 26*a*, 28*a* and 30*a* through body 12*a* and extending laterally thereof to terminate in Velcro fasteners 32*a*. Two parallel rows of spaced tear drop shaped vent holes 34*a* are disposed through body 12*a* in order to keep the archer's arm cool.

Arm guard 10*a* also includes a transverse hinge line or groove 36 separating front end 24*a* from the remainder of body 12*a* and permitting end 24*a* to freely flex. In addition, a smooth, rounded, preferably raised longitudinal rib 38 which is colored with a readily visible color extends from line 36 to rear 22*a* and a colored transverse line 40. If desired, rib 38 can be depressed. Lines 36 and 40 together with rib 38 aid the archer in initially aligning guard 10*a* on the archer's arm and then in visually checking the archer's arm alignment during shooting in order to enhance shooting accuracy. Proper positioning of the archer's bow arm is important for this purpose. Guard 10*a* can be fabricated similar to guard 10 and has the advantages thereof.

Various changes, modifications, alterations and additions can be made in the improved arm guard of the present invention, its components and their parameters. All such changes, modifications, additions and alterations as are within the scope of the appended claims form part of the present invention.

What is claimed is:

1. An improved archery arm guard, said guard comprising, in combination:

a. an elongated, curved, protective, smooth surfaced, self-supporting, rigid plastic body having a plurality of air holes, said body defining a plurality of passageways extending therethrough; and, b. a plurality of parallel elastic stretchable bands slideably disposed in said passageways and extending outwardly therefrom for releasably securing said body to an archer's arm to protect against bowstring slap, said body being curved transversely to fit the contour of an archer's arm, the rear end thereof being curved down to prevent inadvertent hooking of the bowstring under said rear end and the front end thereof being curved up to prevent binding thereof against an archer's wrist.

2. The improved archery arm guard of claim 1 wherein said securing means comprise stretchable bands and wherein said passageways are generally transverse of said body.

3. The improved archery arm guard of claim 2 wherein said bands include means for lengthening, shortening, opening and closing said bands and wherein said bands slide in said passageways.

4. The improved archery arm guard of claim 1 wherein each of said bands has the free ends bearing means to releasably secure said ends together and to shorten and lengthen said bands.

5. The improved archery arm guard of claim 1 wherein said arm guard front end is transversely hinged to and part of the remainder of said body.

6. The improved archery arm guard of claim 1 wherein said indicia comprises at least one straight colored line disposed longitudinally on the upper surface of said body.

7. The improved archery arm guard of claim 6 wherein said colored line is raised and wherein said body slopes down from about the rear end thereof to about the front end thereof.

* * * * *